US009677189B2

(12) United States Patent
Minami

(10) Patent No.: US 9,677,189 B2
(45) Date of Patent: Jun. 13, 2017

(54) PLATING APPARATUS AND METHOD OF DETERMINING ELECTRIC RESISTANCE OF ELECTRIC CONTACT OF SUBSTRATE HOLDER

(71) Applicant: Ebara Corporation, Tokyo (JP)

(72) Inventor: Yoshio Minami, Tokyo (JP)

(73) Assignee: Ebara Corporation, Tokyo (JP)

( * ) Notice: Subject to any disclaimer, the term of this patent is extended or adjusted under 35 U.S.C. 154(b) by 119 days.

(21) Appl. No.: 14/670,647

(22) Filed: Mar. 27, 2015

(65) Prior Publication Data

US 2015/0276835 A1 Oct. 1, 2015

(30) Foreign Application Priority Data

Mar. 31, 2014 (JP) ..... 2014-073289
Mar. 25, 2015 (JP) ..... 2015-063239

(51) Int. Cl.

*C25D 7/12* (2006.01)
*C25D 17/00* (2006.01)
*C25D 21/12* (2006.01)
*C25D 17/06* (2006.01)

(52) U.S. Cl.

CPC ..... *C25D 7/12* (2013.01); *C25D 17/001* (2013.01); *C25D 17/005* (2013.01); *C25D 21/12* (2013.01); *C25D 17/06* (2013.01)

(58) Field of Classification Search

CPC ..... C25D 7/12; C25D 17/001; C25D 17/005; C25D 21/12; C25D 17/06
USPC ..... 324/754.05
See application file for complete search history.

(56) References Cited

U.S. PATENT DOCUMENTS 2,802,182 A * 8/1957 Godshalk ..... G01N 27/06 324/117 R
4,109,196 A * 8/1978 Carmody ..... G01R 27/14 324/123 C
4,519,401 A * 5/1985 Ko ..... A61B 5/031 128/903
6,500,317 B1 12/2002 Yoshioka et al.
(Continued)

FOREIGN PATENT DOCUMENTS

JP 2005-146399 6/2005
WO WO 99/31304 6/1999
(Continued)

*Primary Examiner* — Patrick Assouad
*Assistant Examiner* — Christopher McAndrew
(74) *Attorney, Agent, or Firm* — Leydig, Voit & Mayer, Ltd.

(57) ABSTRACT

A plating apparatus that can obtain each one of electric resistances of plural inner contacts of a substrate holder is disclosed. The plating apparatus includes a resistance-measuring device configured to measure a combined resistance of two electric contacts selected from the plural electric contacts, repeat measuring of a combined resistance of two electric contacts while changing a combination of two electric contacts until a same number of plural combined resistances as the plural electric contacts are measured, create linear equations by coupling each of the plural combined resistances to two variables with use of an equal sign, the two variables representing electric resistances of the corresponding two electric contacts, and solve the linear equations to determine each one of electric resistances of the plural electric contacts.

6 Claims, 13 Drawing Sheets

(56) References Cited

U.S. PATENT DOCUMENTS

| | | | | |
|---|---|---|---|---|
| 6,517,689 | B1 * | 2/2003 | Hongo | G01R 31/026 204/228.7 |
| 9,345,145 | B2 * | 5/2016 | Iwai | H05K 3/187 |
| 2002/0027080 | A1 | 3/2002 | Yoshioka et al. | |
| 2005/0202346 | A1 * | 9/2005 | Yamano | C25D 5/022 430/300 |
| 2011/0313558 | A1 * | 12/2011 | Lehman | B24B 37/013 700/108 |
| 2014/0251814 | A1 * | 9/2014 | Kao | C25D 21/12 205/96 |
| 2014/0367267 | A1 * | 12/2014 | Egan | G01B 7/105 205/84 |

FOREIGN PATENT DOCUMENTS

| | | |
|---|---|---|
| WO | WO 00/03074 | 1/2000 |
| WO | WO 01/68952 A1 | 9/2001 |

* cited by examiner

CREATE LINEAR EQUATIONS

LINEAR EQUATIONS $R1+R7=6$
$R4+R10=9$
$R1+R4=3$
$R1+R10=8$

CALCULATE ELECTRIC RESISTANCES

SOLUTIONS OF THE LINEAR EQUATIONS $R1=1$
$R4=2$
$R7=5$
$R10=7$

PLATING APPARATUS AND METHOD OF DETERMINING ELECTRIC RESISTANCE OF ELECTRIC CONTACT OF SUBSTRATE HOLDER

CROSS REFERENCE TO RELATED APPLICATIONS

This document claims priorities to Japanese Patent Application Number 2014-073289 filed Mar. 31, 2014 and Japanese Patent Application Number 2015-063239 filed Mar. 25, 2015, the entire contents of which are hereby incorporated by reference.

BACKGROUND

There is known a plating apparatus configured to hold a substrate, such as a wafer, with a substrate holder and to immerse the substrate in a plating solution retained in a plating bath. As shown in FIG. 14, the substrate holder includes a plurality of inner contacts 100 that are brought into contact with a peripheral portion of a substrate W, and a plurality of outer contacts 101 coupled to the inner contacts 100, respectively. Wires 104, which provide electric connection between the inner contacts 100 and the outer contacts 101, are located in the substrate holder. When the substrate holder is disposed at a predetermined position in the plating bath, the outer contacts 101 are brought into contact with a power feeding terminal 103 that is coupled to a power supply 102. Electric current flows through the outer contacts 101 and the inner contacts 100 to the substrate W, so that a metal film is formed on a surface of the substrate W in the presence of the plating solution.

If an electric resistance between a certain inner contact 100 and the substrate W (which will be simply referred to as an electric resistance of inner contact 100) is extremely high or extremely low, uneven current flows through the inner contacts 100 to the substrate W, possibly causing a problem of non-uniform film thickness in a substrate surface.

Thus, in order to check whether or not the inner contacts 100 have abnormal electric resistances, a combined resistance including electric resistances of two inner contacts 100 is measured. When the substrate holder is holding the substrate W, the inner contacts 100 are electrically connected to each other through a conductive layer (e.g., a seed layer) of the substrate W. Specifically, when a resistance-measuring device is coupled to two of the outer contacts 101, an electric circuit is formed to electrically connect the substrate W, two inner contacts 100, and the resistance-measuring device. Therefore, the resistance-measuring device can measure a combined resistance including the electric resistances of the two inner contacts 100. If the combined resistance is not within a predetermined allowable range, it is judged that the inner contacts 100 have abnormal electric resistances.

The resistance-measuring device can measure the combined resistance including the electric resistances of the two inner contacts 100, but cannot measure each one of the electric resistances of the two inner contacts 100. Therefore, it is not possible to determine whether one of the two inner contacts 100 is in an abnormal contact state or both of the two inner contacts 100 are in an abnormal contact state. Moreover, even if one of the electric resistances of the two inner contacts 100 is extremely low and the other is extremely high, it is impossible to find out a problematic contact state of the inner contacts 100 as long as the combined resistance falls within the predetermined allowable range.

If a certain inner contact 100 has an extremely high electric resistance or an extremely low electric resistance, non-uniform electric current is passed to the substrate W during plating of the substrate W, thus preventing a uniformity of a thickness of a metal film formed on the surface of the substrate W.

SUMMARY OF THE INVENTION

Embodiments, which will be described below, provide a plating apparatus that can identify, among multiple electric contacts (or inner contacts) of a substrate holder, an electric contact (or inner contact) that has an abnormal electric resistance, i.e., an electric contact that is in an abnormal state of contact with a substrate, in order to detect an abnormality in the electric resistance of one or more of the multiple electric contacts prior to plating of a substrate to thereby ensure a uniform film thickness of a plated substrate. Further, an embodiment, which will be described below, provides a method of determining the electric resistance of each one of the electric contacts of the substrate holder.

The embodiments relate to a plating apparatus capable of plating a substrate, such as a wafer, and further relate to a method of determining electric resistances of electric contacts included in a substrate holder for use in plating of a substrate.

In an embodiment, there is provided a plating apparatus comprising: a substrate holder having plural electric contacts that can be brought into contact with a substrate; a plating bath for storing a plating solution therein, the substrate held by the substrate holder being able to be located in the plating bath; an anode disposed in the plating bath; and a resistance-measuring device configured to measure combined resistances of the plural electric contacts, the resistance-measuring device is configured to measure a combined resistance of two electric contacts selected from the plural electric contacts, repeat measuring of a combined resistance of two electric contacts while changing a combination of two electric contacts until a same number of plural combined resistances as the plural electric contacts are measured, create linear equations by coupling each of the plural combined resistances to two variables with use of an equal sign, the two variables representing electric resistances of the corresponding two electric contacts, and solve the linear equations to determine each one of electric resistances of the plural electric contacts.

In an embodiment, the plating apparatus further comprises a resistance checker configured to determine whether or not the determined electric resistance falls within a predetermined range.

In an embodiment, the resistance checker is configured to emit an alarm signal if the determined electric resistance does not fall within the predetermined range.

In an embodiment, the resistance-measuring device is configured to determine each one of electric resistances of the plural electric contacts before the substrate is transported to the plating bath.

In an embodiment, there is provided a method of determining electric resistances of plural electric contacts of a substrate holder for use in plating of a substrate, comprising: measuring a combined resistance of two electric contacts selected from the plural electric contacts; repeating measuring of a combined resistance of two electric contacts while changing a combination of two electric contacts until a same number of plural combined resistances as the plural electric contacts are measured; creating linear equations by coupling each of the plural combined resistances to two variables with use of an equal sign, the two variables representing electric resistances of the corresponding two electric contacts; and solving the linear equations to determine each one of electric resistances of the plural electric contacts.

The resistance-measuring device can determine each one of the electric resistances of the plural electric contacts. Therefore, it is possible, before starting of the substrate plating, to identify a substrate and/or a substrate holder that can cause an abnormal electric resistance. As a result, a failure of the substrate plating can be avoided.

DESCRIPTION OF EMBODIMENTS

Figure 1:
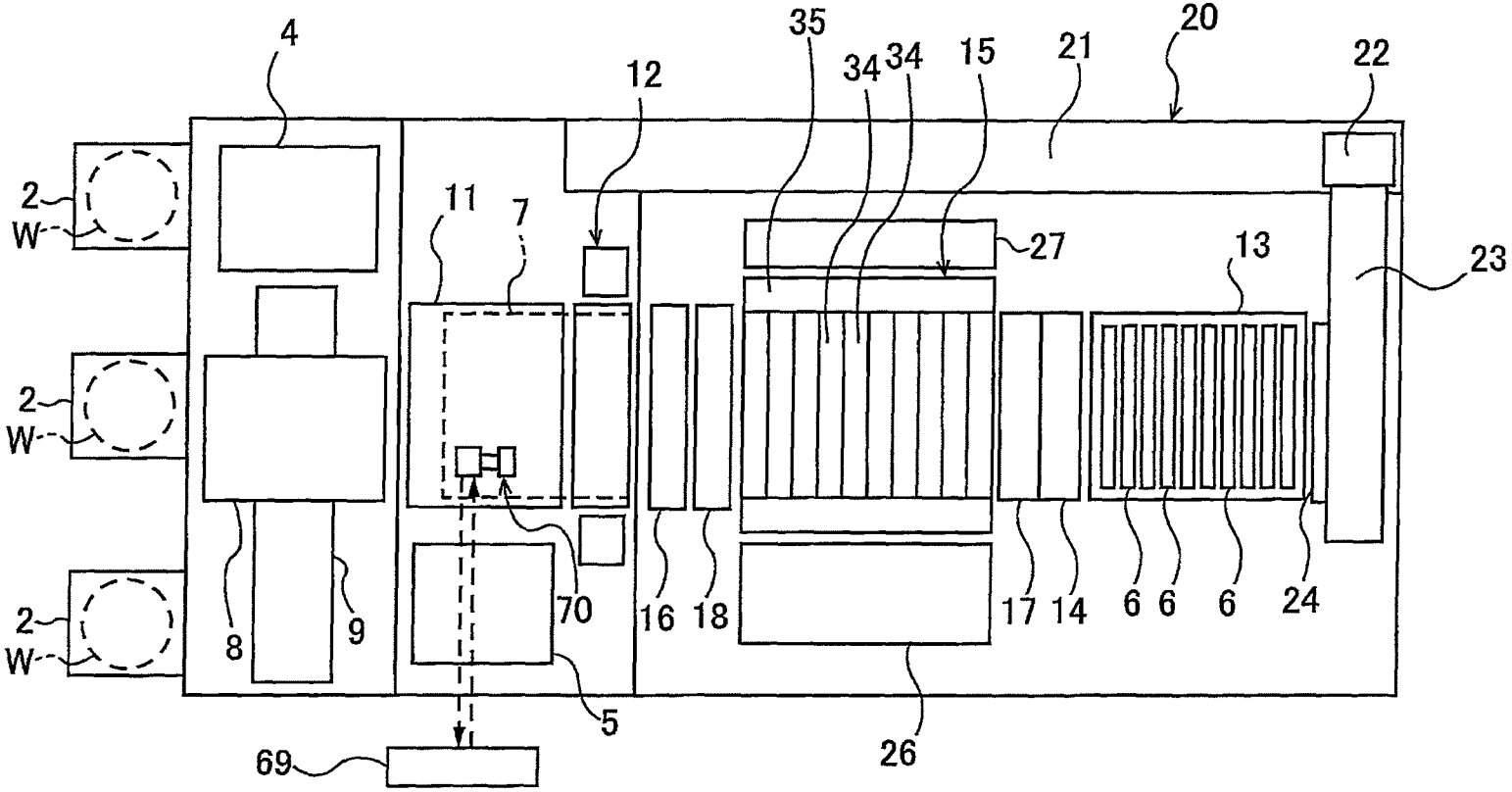
FIG. 1 is a plan view showing a plating apparatus according to an embodiment.

Embodiments will be described below with reference to the drawings. In FIGS. 1 through 13, same or corresponding components will be denoted by the same reference numerals, and repetitive descriptions thereof are omitted. FIG. 1 is a plan view showing a plating apparatus according to an embodiment. The plating apparatus according to this embodiment is an electrolytic plating apparatus configured to pass an electric current through a plating solution to plate a surface of a substrate with metal.

As shown in FIG. 1, the plating apparatus includes loading ports 2 on which substrate cassettes (i.e., substrate storage containers), each storing substrates W therein, are placed, and an aligner 4 for aligning an orientation flat or a notch of a substrate W in a predetermined direction. The plating apparatus further includes a spin-rinse-dryer (SRD) 5 for drying a plated substrate W by rotating it at a high speed, a table 7 on which a substrate holder 6 (see FIGS. 3 through 6) is placed, and a substrate-holder opening and closing mechanism 11 for opening and closing the substrate holder 6 placed on the table 7. The substrate-holder opening and closing mechanism 11 is located above the table 7. A substrate-holder tilting mechanism 12, which is configured to set the substrate holder 6 upright and put the substrate holder 6 down, is disposed above the table 7. The substrate-holder tilting mechanism 12 is configured to change the substrate holder 6 from a vertical position to a horizontal position and place the substrate holder 6 on the table 7.

A moving mechanism 9 is provided along an arrangement direction of the load ports 2, and a substrate transfer robot 8 is installed on the moving mechanism 9. The substrate transfer robot 8 is configured to move on the moving mechanism 9 to access the loading ports 2, the substrate-holder opening and closing mechanism 11, and the aligner 4.

The plating apparatus includes a holder storage bath 13 for storing the substrate holders 6 therein, a pre-cleaning bath 14 for cleaning the substrate W, held by the substrate holder 6, with a cleaning liquid, such as pure water, and a pretreatment bath 17 for pretreating the substrate W, held by the substrate holder 6, with a pretreatment liquid. Further, the plating apparatus includes a plating bath 15 for storing a plating solution therein for plating the substrate W, a rinsing bath 18 for rinsing the plated substrate W with a rinsing liquid, and a blow bath 16 for removing liquid from the substrate W. The blow bath 16 is configured to emit a jet of air onto the substrate W, held by the substrate holder 6, to remove droplets remaining on the surface of the substrate W to dry the substrate W. A paddle motor unit 26 for driving a paddle 37 (see FIG. 2) for agitating the plating solution in the plating bath 15 is provided at one side of the plating bath 15. An exhaust duct 27 is provided at the other side of the plating bath 15.

The plating apparatus includes a transport device (or a transporter) 20 for transporting substrate holders 6, each holding the substrate W, one by one between the holder storage bath 13, the pre-cleaning bath 14, the pretreatment bath 17, the plating bath 15, the rinsing bath 18, the blow bath 16, and the substrate-holder opening and closing mechanism 11.

The transporter 20 includes a fixed base 21 extending along an arrangement direction of the plating bath 15, a lifter 22 configured to be movable horizontally on the fixed base 21, and an arm 23 coupled to the lifter 22. The arm 23 has a gripper 24 for gripping the substrate holder 6. The arm 23 and the lifter 22 horizontally move together, and the arm 23 is elevated and lowered by the lifter 22. A linear motor or a rack and pinion may be used as a driving device for horizontally moving the lifter 22 and the arm 23.

The plating apparatus further includes a controller 69. Operations of units including the pre-cleaning bath 14, the plating bath 15, the blow bath 16, the pretreatment bath 17, the rinsing bath 18, and the transporter 20 are controlled by the controller 69.

Figure 2:
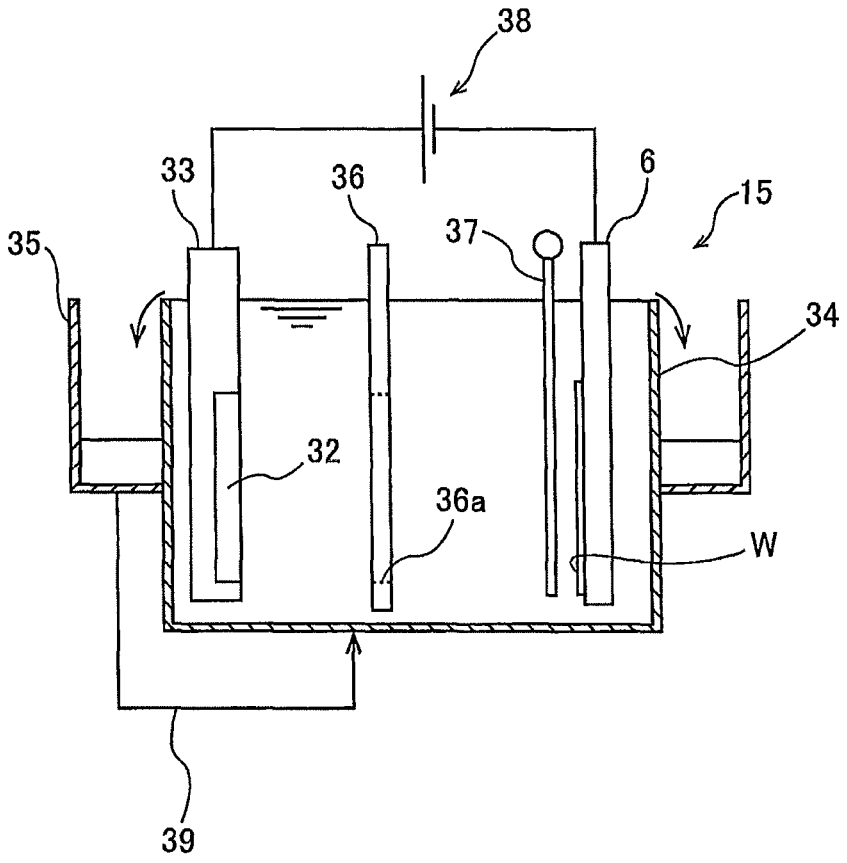
FIG. 2 is a vertical cross-sectional view of a plating bath.
Figure 3:
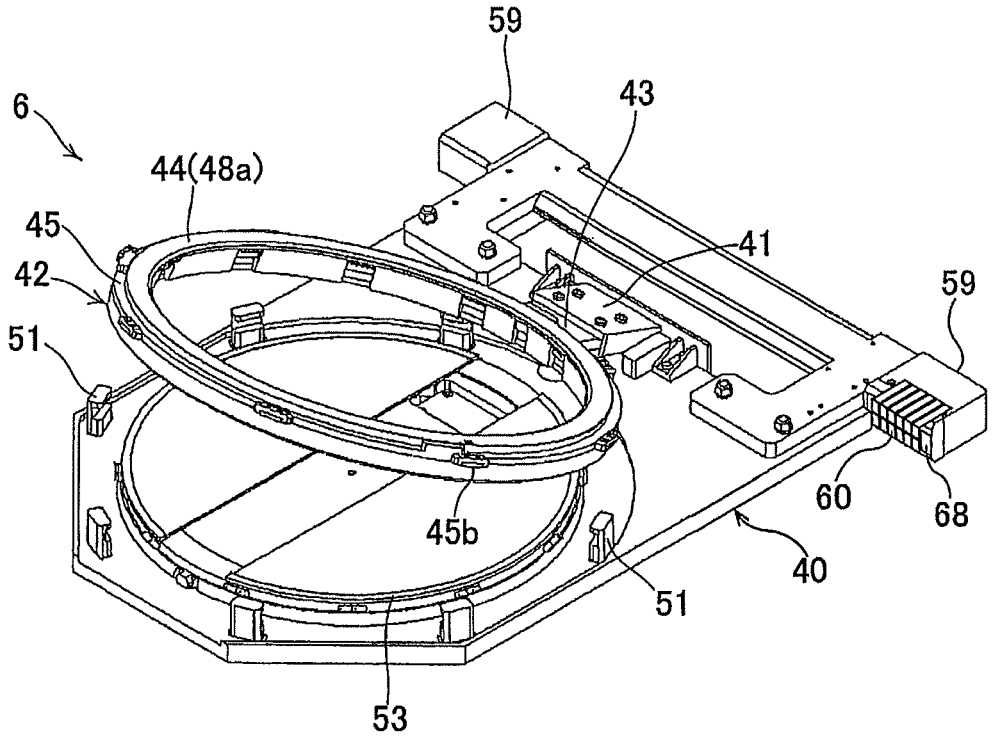
FIG. 3 is a perspective view showing an embodiment of a substrate holder.

FIG. 2 is a vertical cross-sectional view of the plating bath 15. As shown in FIG. 2, the plating apparatus includes the plating bath 15 for storing the plating solution therein, an anode 32 disposed in the plating bath 15, an anode holder 33 that holds the anode 32, and the substrate holder 6 for removably holding the substrate W and for immersing the substrate W in the plating solution held in the plating bath 15.

The plating bath 15 includes an inner bath 34. The substrate W, held by the substrate holder 6, and the anode 32 are located in the inner bath 34. The plating bath 15 further includes an overflow bath 35 that is adjacent to the inner bath 34. The plating solution in the inner bath 34 overflows a side wall of the inner bath 34 into the overflow bath 35. The anode 32 and the substrate W are disposed opposite each other in the inner bath 34.

As shown in FIG. 2, the plating apparatus further includes a regulation plate 36 having an opening 36*a* for regulating an electric potential distribution on the substrate W, and a paddle 37 for agitating the plating solution in the inner bath 34. The regulation plate 36 is located between the anode 32 and the substrate W. The paddle 37 is located near the surface of the substrate W held by the substrate holder 6 in the inner bath 34. The paddle 37 is disposed in a vertical position and reciprocates parallel to the substrate W to thereby agitate the plating solution. The paddle 37 agitates the plating solution during plating of the substrate W, so that sufficient metal ions can be evenly distributed to the surface of the substrate W.

The anode 32 is coupled to a positive electrode of a plating power source 38 via the anode holder 33, and the substrate W is coupled to a negative electrode of the plating power source 38 via the substrate holder 6. When a voltage is applied between the anode 32 and the substrate W, an electric current is passed to the substrate to W thereby form a metal film on the surface of the substrate W.

One end of a plating-solution circulation line 39 is coupled to a bottom of the overflow bath 35, and other end of the plating-solution circulation line 39 is coupled to a bottom of the inner bath 34. The plating solution overflows the inner bath 34 into the overflow bath 35 and is returned from the overflow bath 35 through the plating-solution circulation line 39 into the inner bath 34. In this manner, the plating solution circulates between the inner bath 34 and the overflow bath 35 through the plating-solution circulation line 39.

The substrate holder 6 will be described with reference to FIGS. 3 through 6. As shown in FIGS. 3 through 6, the substrate holder 6 includes a first holding member 40 having a rectangular plate shape and a second holding member 42 rotatably coupled to the first holding member 40 through a hinge 41. Although in this embodiment the second holding member 42 is configured to be openable and closable through the hinge 41, it is also possible to dispose the second holding member 42 opposite to the first holding member 40 and to move the second holding member 42 away from and toward the first holding member 40 to thereby open and close the second holding member 42.

The first holding member 40 may be made of vinyl chloride. The second holding member 42 includes a base portion 43 and a ring-shaped seal holder 44. The seal holder 44 may be made of vinyl chloride. An annular substrate-side sealing member 46 (see FIG. 5 and FIG. 6), which projects inwardly, is attached to an upper portion of the seal holder 44. This substrate-side sealing member 46 is placed in pressure contact with a periphery of the surface of the substrate W to seal a gap between the second holding member 42 and the substrate W when the substrate W is held by the substrate holder 6. An annular holder-side sealing member 47 (see FIG. 5 and FIG. 6) is attached to a surface, facing the first holding member 40, of the seal holder 44. This holder-side sealing member 47 is placed in pressure contact with the first holding member 40 to seal a gap between the first holding member 40 and the second holding member 42 when the substrate W is held by the substrate holder 6. The holder-side sealing member 47 is located at the outer side of the substrate-side sealing member 46.

Figure 6:
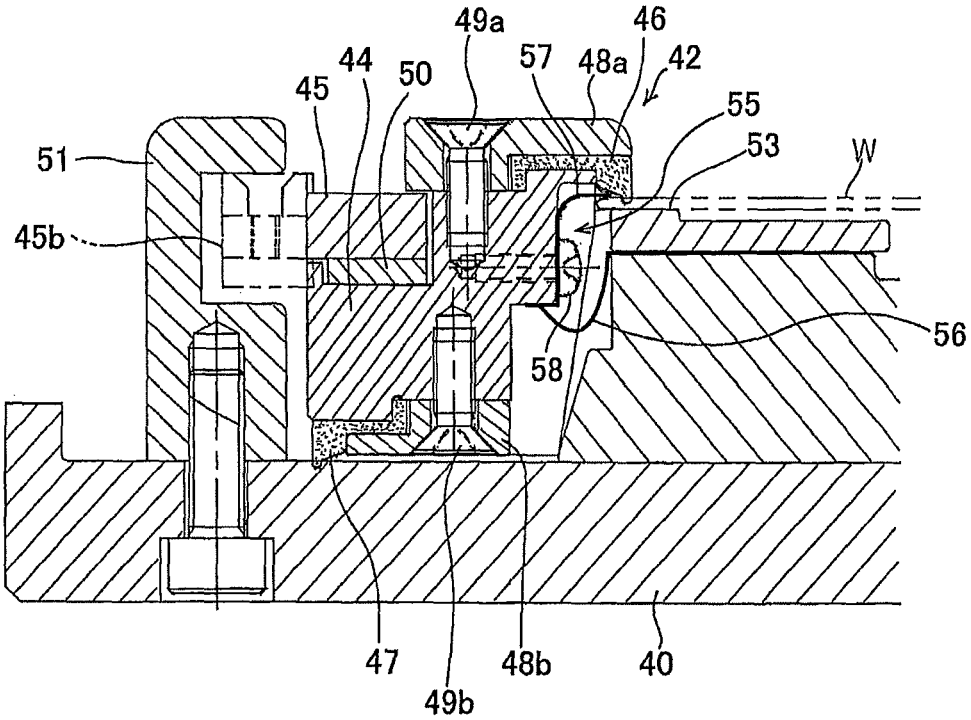
FIG. 6 is an enlarged view showing an encircled area indicated by symbol A shown in FIG. 5.

As shown in FIG. 6, the substrate-side sealing member 46 is sandwiched between the seal holder 44 and a first mounting ring 48*a*, so that the substrate-side sealing member 46 is secured to the seal holder 44. The first mounting ring 48*a* is secured to the seal holder 44 by fastening devices 49*a*, such as screws. The holder-side sealing member 47 is sandwiched between the seal holder 44 and a second mounting ring 48*b*, so that the holder-side sealing member 47 is secured to the seal holder 44. The second mounting ring 48*b* is secured to the seal holder 44 by fastening devices 49*b*, such as screws.

The seal holder 44 has a stepped portion at a periphery thereof, and a retaining ring 45 is rotatably mounted to the stepped portion through a spacer 50. The retaining ring 45 is inescapably held by an outer peripheral portion of the first mounting ring 48*a*. This retaining ring 45 is made of a material (e.g., titanium) having high rigidity and excellent acid and alkali corrosion resistance. The spacer 50 is made of a material having a low friction coefficient, for example PTFE, so that the retaining ring 45 can rotate smoothly.

Inverted L-shaped clampers 51, each having an inwardly projecting portion and located at the outer side of the retaining ring 45, are secured to the first holding member 40 at equal intervals along a circumferential direction of the retaining ring 45. The retaining ring 45 has, on its outer circumferential surface, outwardly projecting portions 45*b* arranged at positions corresponding to positions of the clampers 51. A lower surface of the inwardly projecting portion of each clamper 51 and an upper surface of each projecting portion 45*b* of the retaining ring 45 are inclined in opposite directions along the rotational direction of the retaining ring 45 to form inclined surfaces. A plurality (e.g., three) of upwardly projecting protrusions 45*a* are provided on the retaining ring 45 at predetermined locations along the circumferential direction of the retaining ring 45. The retaining ring 45 can be rotated by pushing and moving each protrusion 45*a* in a lateral direction by means of a rotating pin (not shown).

With the second holding member 42 open, the substrate W is inserted into the central portion of the first holding member 40, and the second holding member 42 is then closed through the hinge 41. Subsequently the retaining ring 45 is rotated clockwise so that each projecting portion 45*b* of the retaining ring 45 slides into the inwardly projecting portion of each clamper 51. As a result, the first holding member 40 and the second holding member 42 are fastened to each other and locked by engagement between the inclined surfaces of the retaining ring 45 and the inclined surfaces of the clampers 51. The second holding member 42 can be unlocked by rotating the retaining ring 45 counter-clockwise to disengage the projecting portions 45*b* of the retaining ring 45 from the inverted L-shaped clampers 51.

When the second holding member 42 is fastened to the first holding member 40, a downwardly-protruding portion of the substrate-side sealing member 46 is placed in pressure contact with the periphery of the surface of the substrate W. The substrate-side sealing member 46 is pressed uniformly against the substrate W to thereby seal the gap between the periphery of the surface of the substrate W and the second holding member 42. Similarly, when the second holding member 42 is fastened to the first holding member 40, a downwardly-protruding portion of the holder-side sealing member 47 is placed in pressure contact with the surface of the first holding member 40. The sealing holder-side sealing member 47 is uniformly pressed against the first holding member 40 to thereby seal the gap between the first holding member 40 and the second holding member 42.

The second holding member 42 is opened and closed by a not-shown pneumatic cylinder and by a weight of the second holding member 42. More specifically, the first holding member 40 has a through-hole 40*a*, and the pneumatic cylinder (not shown) is disposed at a position opposite to the through-hole 40*a* when the substrate holder 6 is mounted on the table 7. The second holding member 42 is opened by extending a piston rod of the pneumatic cylinder through the through-hole 40*a* to push up the seal holder 44 of the second holding member 42. The second holding member 42 is closed by its own weight when the piston rod is retracted.

A protruding portion 52, which is in a ring shape corresponding to a size of the substrate W, is formed on an upper surface of the first holding member 40. This protruding portion 52 has an annular support surface 53 which comes in contact with the periphery of the substrate W to support the substrate W. The protruding portion 52 has recesses 54 located at predetermined positions along a circumferential direction of the protruding portion 52.

Figure 4:
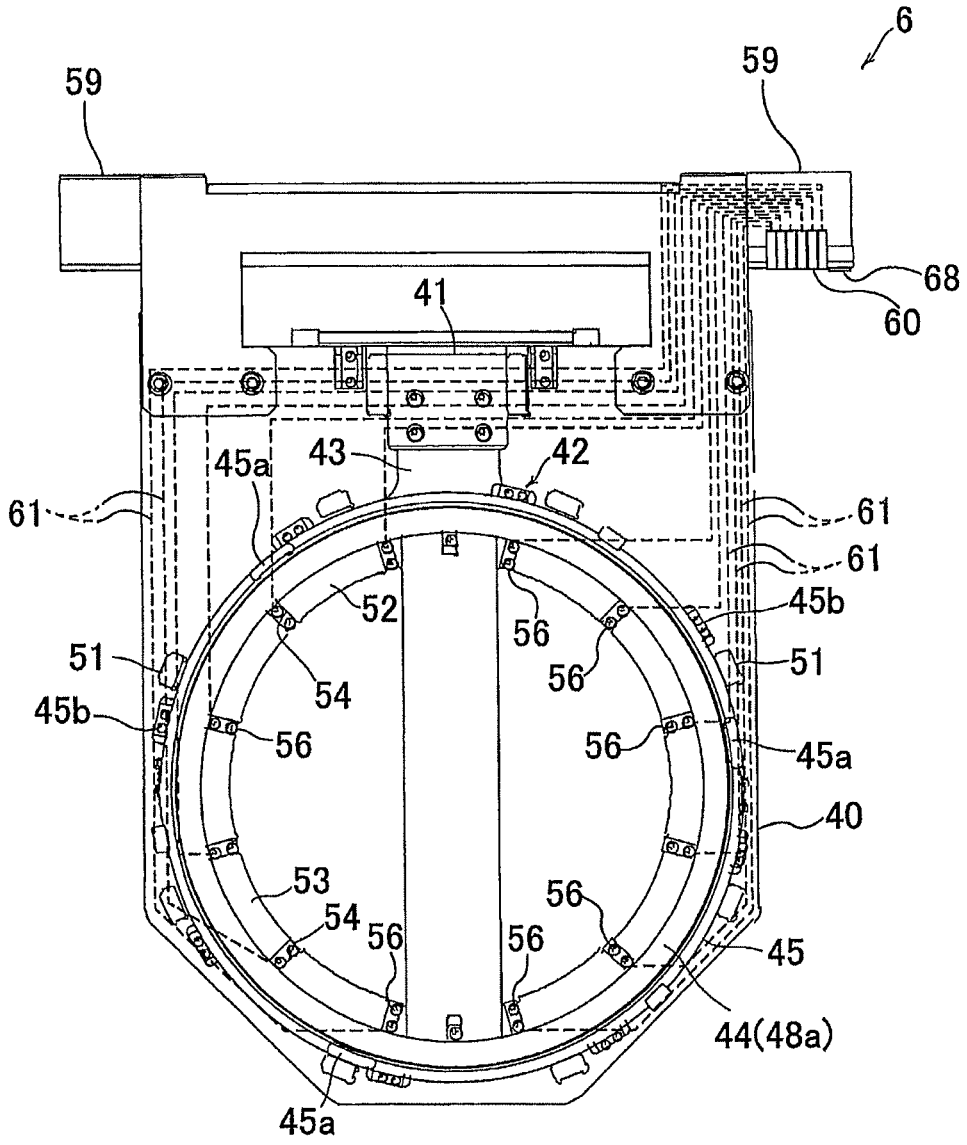
FIG. 4 is a plan view of the substrate holder shown in FIG. 3.
Figure 5:
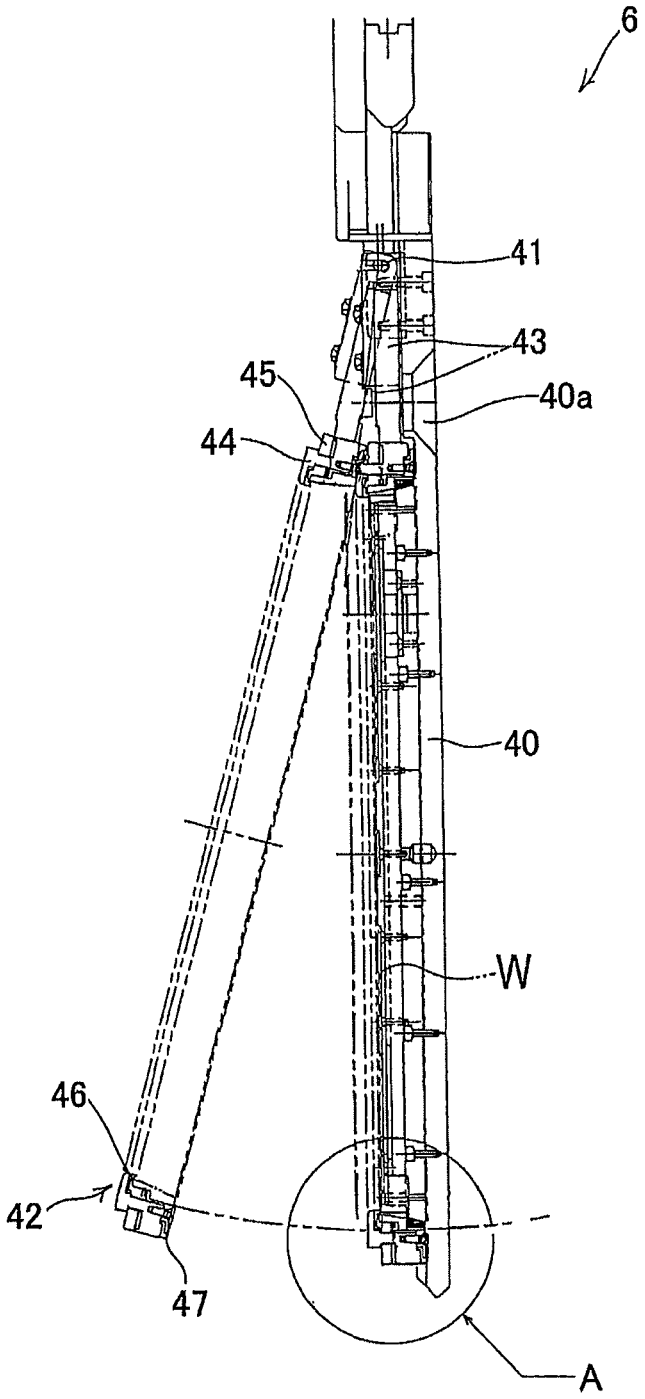
FIG. 5 is a right side view of the substrate holder shown in FIG. 3.

As shown in FIG. 6, the substrate holder 6 further includes a plurality of inner contacts (electric contacts) 55 to be brought into contact with the peripheral portion of the substrate W to pass the electric current to the substrate W. Each inner contact 55 includes a conductive member 56 and a contact member 57. The contact member 57 is located so as to be brought into contact with the conductive member 56 and the peripheral portion of the substrate W. As shown in FIG. 4, the plural conductive members 56 (e.g., twelve conductive members 56 as illustrated) are disposed in the recesses 54, respectively. The conductive members 56 are secured to the first holding member 40, while the contact members 57 are secured to the second holding member 42. Therefore, when the second holding member 42 is opened, the contact members 57 are separated away from the conductive members 56. When the second holding member 42 is closed with the substrate W placed on the support surface 53 of the first holding members 40, the contact members 57 elastically make contact with distal ends of the conductive members 56, respectively, as shown in FIG. 6. The number of contact members 57 (twelve contact members 57 in this embodiment) is the same as the number of conductive members 56. That is, twelve inner contacts (electric contacts) 55 are provided in this embodiment.

The contact members 57, which are to be electrically connected to the conductive members 56, are secured to the seal holder 44 of the second holding member 42 by fastening devices 58, such as screws. The contact members 57 each have a leaf spring-like contact portion located outside the substrate-side sealing member 46 and projecting inwardly. The contact members 57 are springy and bend easily. When the substrate W is sandwiched between the first holding member 40 and the second holding member 42, contact portions of the contact members 57 make elastic contact with the peripheral portion of the substrate W supported on the support surface 53 of the first holding member 40, while lower portions of the contact members 57 are placed in contact with the conductive members 56, respectively.

As shown in FIG. 4, a pair of holder hangers 59 is provided on an end portion of the first holding member 40. Twelve outer contacts 60 are provided on one of the two holder hangers 59. These twelve outer contacts 60 are coupled to the twelve conductive members 56 via twelve wires 61, respectively. The wires 61 are disposed in the substrate holder 6.

Figure 7:
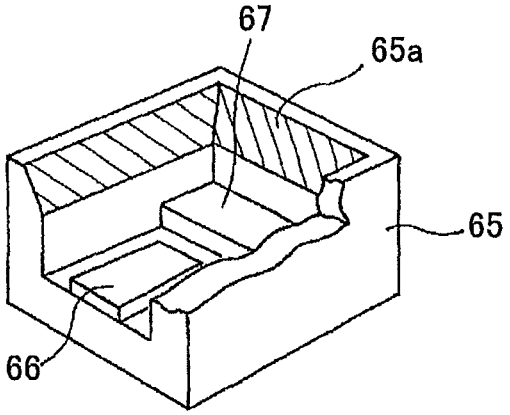
FIG. 7 is a view showing a holder support member provided on a surrounding wall of the plating bath.

The substrate holder 6, with its holder hanger 59 placed on a surrounding wall of the plating bath 15, is suspended from the surrounding wall of the plating bath 15. FIG. 7 is a view showing a holder support member 65 provided on the surrounding wall of the plating bath 15. The holder support member 65 for supporting the holder hanger 59 having the outer contacts 60 is disposed on the surrounding wall of the plating bath 15. As shown in FIG. 7, the holder support member 65 has an opening 65*a* in an upper surface thereof. The outer contacts 60 are set in the holder support member 65 through the opening 65*a*. A power feeding terminal 66, which is coupled to the plating power supply 38, is disposed in the holder support member 65. When the holder hanger 59 is placed into the holder support member 65, the outer contacts 60 are brought into contact with the power feeding terminal 66.

If the substrate holder 6 oscillates due to the motion of the paddle 37 when plating of the substrate W is performed, the electric connection between the outer contacts 60 and the power feeding terminal 66 may become intermittent. Therefore, in order to prevent such intermittent connection, the holder support member 65 has a magnet 67, and the substrate holder 6 has a magnet 68 (see FIG. 4). A magnetic force is generated between these magnets 67, 68 to firmly secure the substrate holder 6 to the plating bath 15, thereby ensuring the contact between the outer contacts 60 and the power feeding terminal 66.

As shown in FIG. 1, the plating apparatus includes a resistance-measuring device 70 for measuring combined resistances including electric resistances of the inner contacts (electric contacts) 55 of the substrate holder 6. This resistance-measuring device 70 is disposed at the substrate-holder opening and closing mechanism 11. The resistance-measuring device 70 is configured to come into contact with the outer contacts 60 and measure the combined resistances including the electric resistances of the inner contacts 55 through the outer contacts 60.

In order to realize a good plating result with a uniform film thickness, it is necessary to uniformly pass the electric current to the inner contacts (electric contacts) 55 of the substrate holder 6. However, if an electric resistance between a certain inner contact 55 and a conductive layer of the substrate W is high, a lower electric current flows through that inner contact 55, while a higher current flows through the neighboring inner contacts 55, resulting in non-uniform plating. The electric resistance of the inner contact 55 often becomes higher than in a normal state in many cases. For example, the electric resistance can increase if a foreign matter or an oxidation layer adheres to the inner contact 55, or if the plating solution adheres to the inner contact 55 as a result of a leakage of the plating solution, or if the inner contact 55 deforms or is not properly mounted, or if the inner contact 55 is not in contact with the substrate W with a sufficient contact area, or if a coating material has been peeled off from the inner contact 55. Moreover, if the conductive layer (e.g., seed layer) is not uniformly formed on the substrate or if a resist film covers a part of an electric feeding region, an abnormal electric resistance can occur. Accordingly, the abnormal electric resistance can occur not only due to the inner contact 55, but also due to the substrate W. In this patent specification, the electric resistance of the inner contact means a resistance that can be varied due to a state of a contact region between the inner contact 55 and the substrate W, and can be defined as an index that indicates an electric feeding state between the inner contact 55 and the substrate W in wide meanings including a problem that can occur due to the damage of the inner contact 55 itself and the substrate W itself. This problem can also occur in the case where the electric resistance of a certain inner contact 55 is higher than those of other inner contacts 55, as well as in the case where a certain inner contact 55 is lower than those of other inner contacts 55 in excess of an allowable level.

Figure 8A:
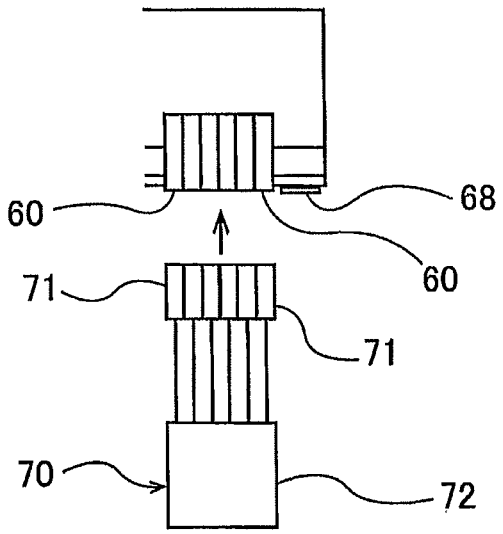
FIG. 8A and FIG. 8B are views showing outer contacts and a resistance-measuring device.
Figure 8B:
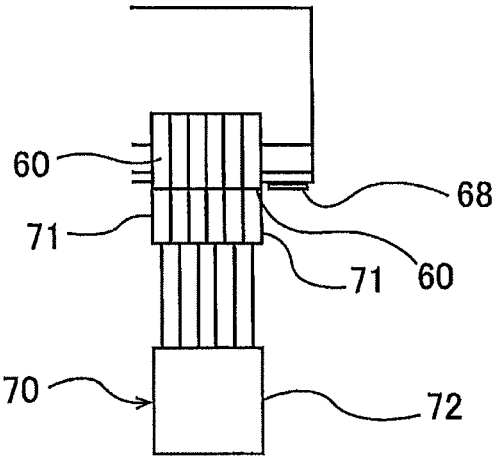

FIG. 8A and FIG. 8B are views each showing the outer contacts 60 and the resistance-measuring device 70. The resistance-measuring device 70 includes probes 71 that are to be brought into contact with the outer contacts 60, respectively, and a resistance determiner 72 configured to measure the combined resistances including the electric resistances of the inner contacts 55 through the outer contacts 60 and the probes 71 and calculate (i.e., determine) an electric resistance of each one of the inner contacts 55 from the measured combined resistances. As shown in FIG. 8A, the resistance-measuring device 70 is moved toward the outer contacts 60 until the probes 71 are brought into contact with the outer contacts 60, respectively, as shown in FIG. 8B.

Figure 9:
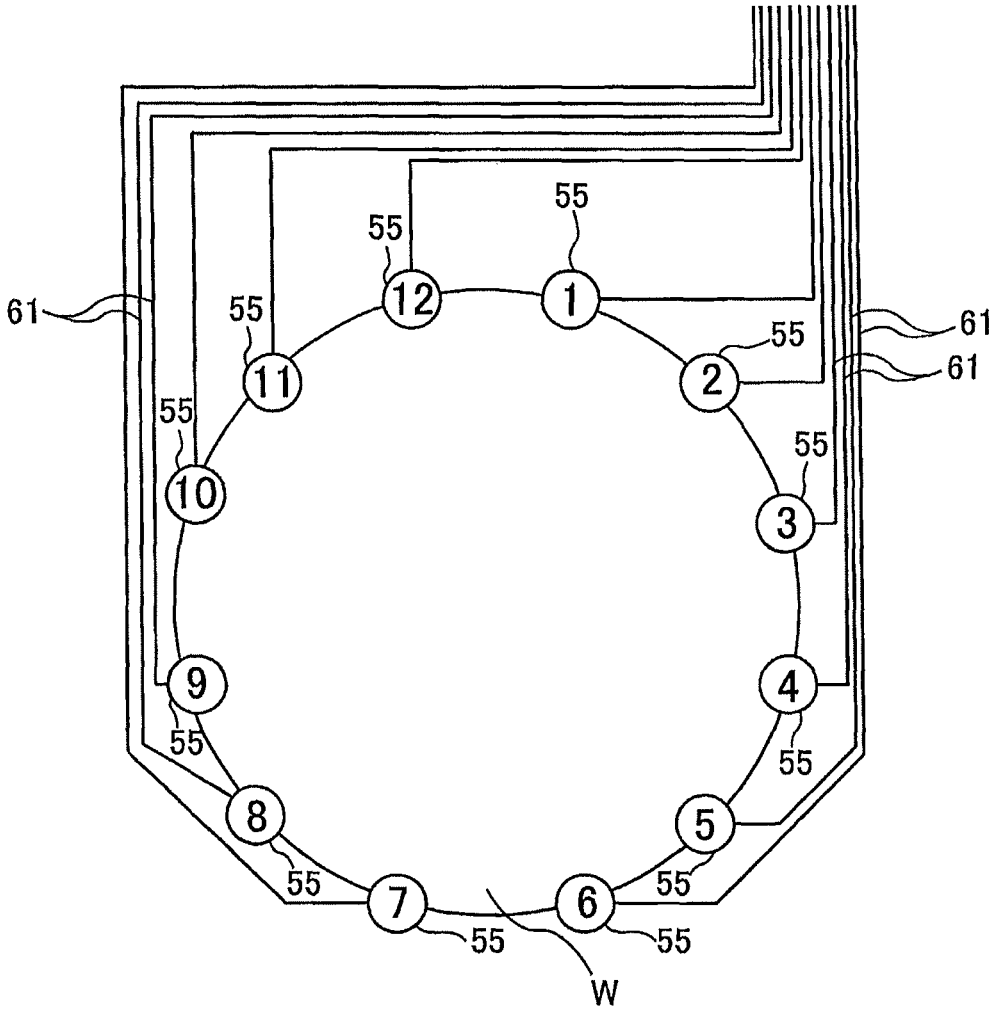
FIG. 9 is a schematic view showing twelve inner contacts (electric contacts) arranged along a circumferential direction of a substrate.
Figure 10:
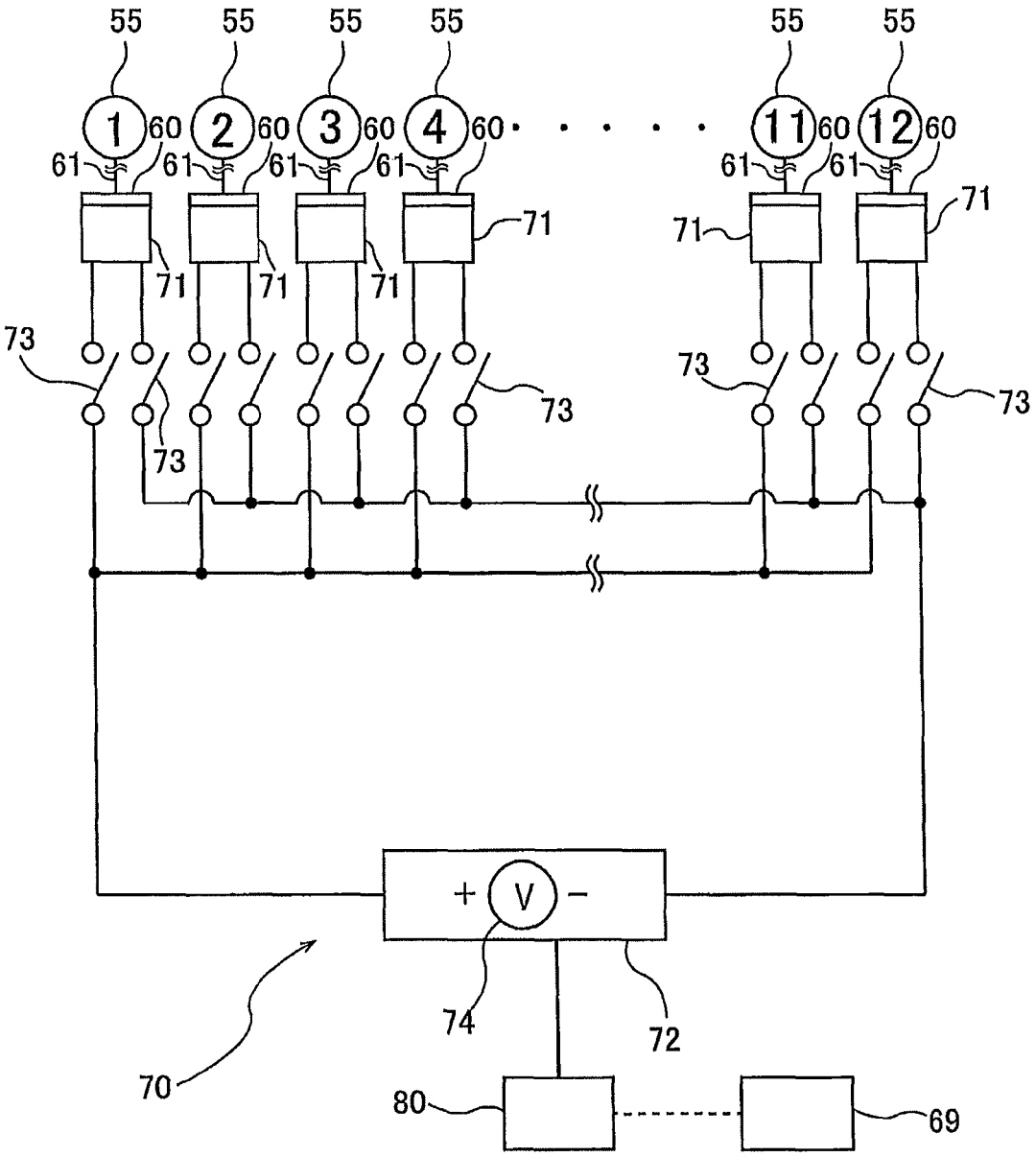
FIG. 10 is a schematic view showing an internal construction of the resistance-measuring device.

FIG. 9 is a schematic view showing the twelve inner contacts (electric contacts) 55 arranged along a circumferential direction of the substrate W. FIG. 10 is a schematic view showing an internal construction of the resistance-measuring device 70. In order to refer to the twelve inner contacts 55 individually, these twelve inner contacts 55 will be numbered from No. 1 to No. 12, respectively. The inner contacts 55 of No. 1 to No. 12 will be hereinafter referred to as a first inner contact 55 to a twelfth inner contact 55, respectively. The twelve inner contacts 55 are coupled to the twelve outer contacts 60 via the twelve wires 61, respectively. When the substrate holder 6 holds the substrate W, the first inner contact 55 to the twelfth inner contact 55 are electrically coupled to each other via a conductive layer (e.g., a seed layer) of the substrate W. The resistance-measuring device 70 measures the combined resistance including the electric resistances of the inner contacts 55 with the substrate W held on the substrate holder 6.

As shown in FIG. 10, the resistance-measuring device 70 has the same number of probes 71 as the outer contacts 60. In this embodiment, twelve probes 71 are provided. Two switches 73, which are arranged in parallel, are coupled to each of the probes 71. One of the two switches 73 is coupled to a positive electrode of a measurement power source 74 of the resistance determiner 72, and the other of the two switches 73 is coupled to a negative electrode of the measurement power source 74.

Figure 11:
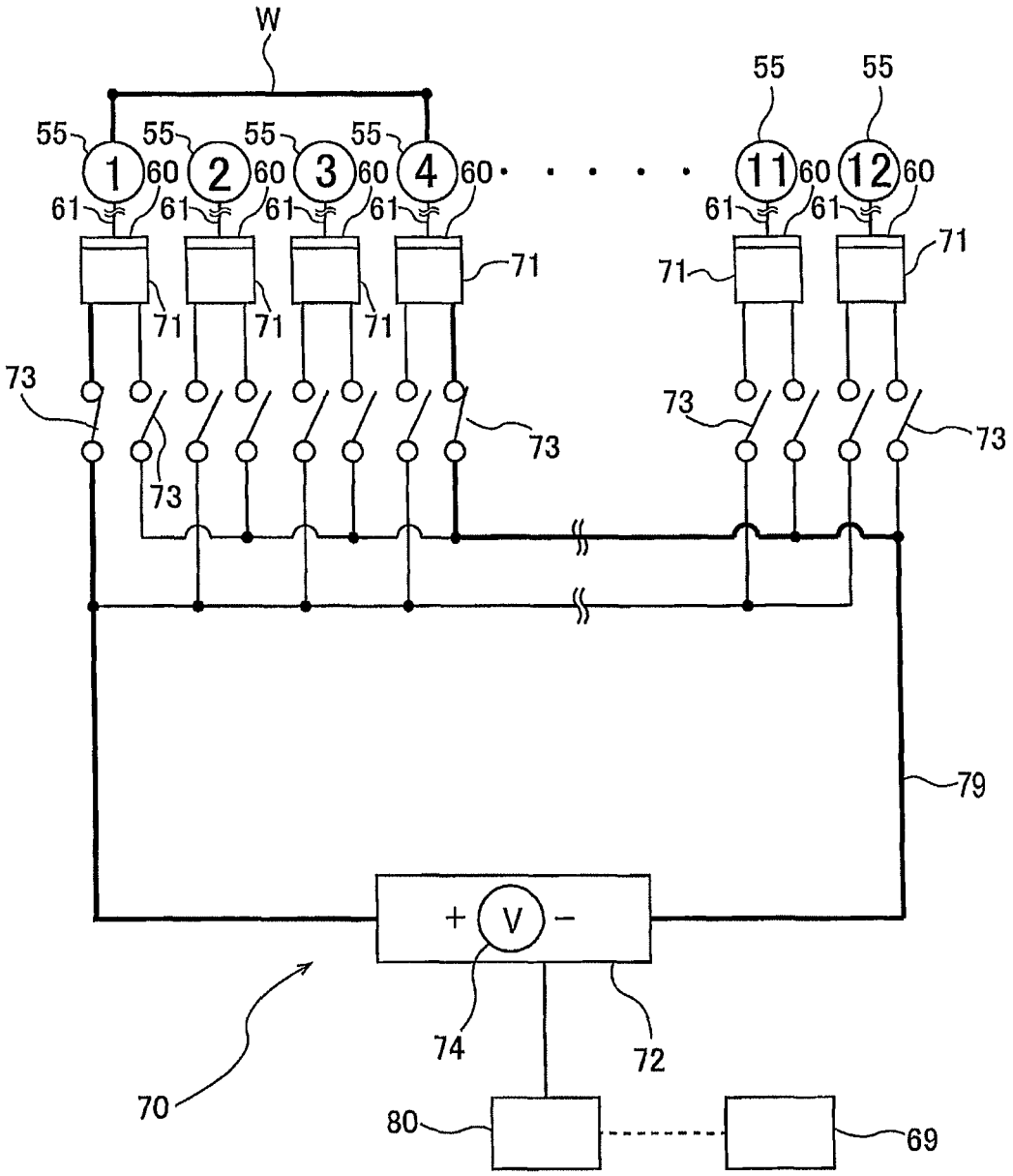
FIG. 11 is a diagram showing a state in which a switch coupled to an inner contact (No. 1) and a switch coupled to an inner contact (No. 4) are closed.

When the switches 73 are opened, the resistance determiner 72 and the probe 71 are disconnected. When the switch 73 is closed, the electric connection between the resistance determiner 72 and the probe 71 is established. For example, as shown in FIG. 11, in order to measure a combined resistance of the first inner contact 55 and the fourth inner contact 55, one of the two switches 73 coupled to the first inner contact 55 is closed and one of the two switches 73 coupled to the fourth inner contact 55 is closed. Thus, as illustrated by thick lines in FIG. 11, the first inner contact 55 and the fourth inner contact 55 are electrically connected to the resistance determiner 72 via the outer contacts 60 and the probes 71. Specifically, the first inner contact 55, the conductive layer of the substrate W, the fourth inner contact 55, and the resistance determiner 72 are electrically connected to form an electric circuit 79. The resistance determiner 72 measures the combined resistance including the respective electric resistances of the first inner contact 55 and the fourth inner contact 55 that are electrically coupled through the conductive layer of the substrate W.

The resistance determiner 72 is configured to calculate (or determine) each one of the electric resistances of the inner contacts 55 from measured combined resistances. An example of a process of determining the electric resistances of the inner contacts 55 will be described with reference to FIG. 12. In this embodiment, the twelve inner contacts 55 are divided into three groups, and electric resistances of four inner contacts 55 belonging to each group are determined. An example of determining each one of the electric resistances of the four inner contacts 55 in one group will be now described. The electric resistances of the inner contacts 55 in another group can also be determined in the same manner.

Figure 12:
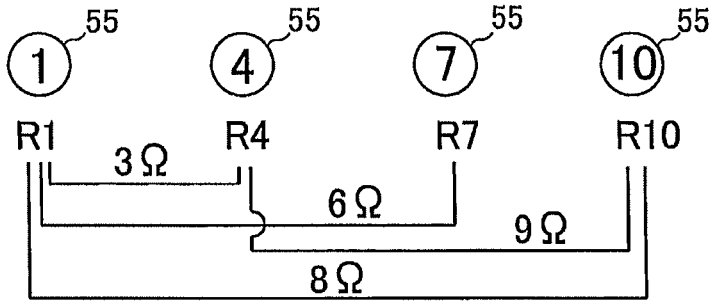
FIG. 12 is a diagram showing a process of determining each value of electric resistances of the inner contacts.

First, the resistance-measuring device 70 measures a combined resistance of two inner contacts 55 selected from plural inner contacts 55 (e.g., four inner contacts 55 in the example shown in FIG. 12). Specifically, the resistance-measuring device 70 measures a resistance of an electric circuit including the two inner contacts 55, the conductive layer of the substrate W, the two outer contacts 60, the two probes 71, and the resistance determiner 72. The electric resistances of the two inner contacts 55 can vary due to various causes as discussed above, while resistances of other elements that form the electric circuit do not vary or are very small. Therefore, in the light of the purpose of identifying the inner contact that is in an abnormal contact state or in an abnormal feeding state, a resistance value of the electric circuit (e.g., the electric circuit 79 shown in FIG. 11) measured by the resistance-measuring device 70 can be regarded as the sum of the electric resistances of the two inner contacts 55. Accordingly, in the following descriptions, the combined resistance is regarded as the sum of the electric resistances of the selected two inner contacts 55, unless otherwise noted.

The measuring operation of a combined resistance is repeated while changing a combination of two inner contacts 55 until the same number of combined resistances as the number of plural (e.g., four in FIG. 12) inner contacts 55 are measured. For example, as shown in FIG. 12, the resistance-measuring device 70 measures four combined resistances, i.e., a combined resistance (e.g., 6[Ω]) of the electric resistance of the first inner contact 55 and the electric resistance of the seventh inner contact 55, a combined resistance (e.g., 9[Ω]) of the electric resistance of the fourth inner contact 55 and the electric resistance of the tenth inner contact 55, a combined resistance (e.g., 3[Ω]) of the electric resistance of the first inner contact 55 and the electric resistance of the fourth inner contact 55, and a combined resistance (e.g., 8[Ω]) of the electric resistance of the first inner contact 55 and the electric resistance of the tenth inner contact 55.

The resistance determiner 72 assigns a variable R1, a variable R4, a variable R7, and a variable R10 to the electric resistances of the first inner contact 55, the fourth inner contact 55, the seventh inner contact 55, and the tenth inner contact 55, respectively. For example, the variable R1 represents the electric resistance of the first inner contact 55, and the variable R4 represents the electric resistance of the fourth inner contact 55. The above-described four combined resistances correspond to four combinations using all of four electric resistances R1, R4, R7, and R10.

The resistance determiner 72 couples each of the measured combined resistances to the sum of two variables representing the electric resistances of the corresponding two inner contacts 55 with use of an equal sign [=] to thereby create a plurality of linear equations. More specifically, the resistance determiner 72 creates a first linear equation R1+R7=6[Ω] by coupling the combined resistance 6[Ω] with the sum of the variables R1, R7 representing the electric resistances of the corresponding first inner contact 55 and seventh inner contact 55 with use of an equal sign. Similarly, the resistance determiner 72 creates a second linear equation R4+R10=9[Ω], a third linear equation R1+R4=3[Ω], and a fourth linear equation R1+R10=8[Ω].

The four combined resistances (6, 9, 3, 8[Ω]) are constituted by four combinations (R1+R7, R4+R10, R1+R4, and R1+R10) using all of the electric resistances R1, R4, R7, and R10 of the four inner contacts 55. In other words, each of the four variables R1, R4, R7, and R10, representing the four electric resistances, is included in at least one of the four linear equations.

The resistance determiner 72 solves the first linear equation to the fourth linear equation to determine the variables R1, R4, R7, and R10, i.e., the four electric resistances of the four inner contacts 55. For example, the resistance determiner 72 creates a fifth linear equation (−R1+R4=1[Ω]) from the second linear equation and the fourth linear equation. Next, the resistance determiner 72 determines a value of the variable R4 (R4=2[Ω]) from the third linear equation and the fifth linear equation, and substitutes the value of the variable R4 into the second linear equation to determine a value of the variable R10 (R10=7[Ω]). The resistance determiner 72 then substitutes the value of the variable R10 into the fourth linear equation to determine a value of the variable R1 (R1=1[Ω]), and substitutes the value of the variable R1 into the first linear equation to determine a value of the variable R7 (R7=5[Ω]).

The resistance determiner 72 repeatedly measures the combined resistance while changing the combination of the inner contacts 55 so that the resistance determiner 72 can calculate all of the individual electric resistances. This measuring operation can be achieved by switching a pattern of opening and closing the switches 73 of the resistance-measuring device 70. The resistance determiner 72 can calculate each one of individual electric resistances from plural linear equations containing the electric resistances as variables.

In this manner, the resistance-measuring device 70 can determine each one of the electric resistances of the multiple inner contacts 55. In a conventional technique, only a combined resistance of two inner contacts 55 can be determined. Therefore, it is not possible to judge whether one or both of the two inner contacts 55 are in an abnormal contact state. According to the above-discussed embodiment, the resistance-measuring device 70 can determine each one of the electric resistances of the inner contacts 55. Therefore, it is possible to identify the inner contact 55 that is in an abnormal contact state.

The resistance-measuring device 70 is coupled to a resistance checker 80 configured to determine whether or not each determined electric resistance is within a predetermined allowable range. The resistance checker 80 is coupled to the controller 69. The resistance checker 80 may be disposed in the resistance-measuring device 70, or may be disposed in the controller 69.

The resistance checker 80 determines whether or not each electric resistance, determined by the resistance-measuring device 70, falls within the predetermined allowable range. If the electric resistance falls within the predetermined allowable range, the resistance checker 80 sends to the controller 69 a permission signal for permitting plating of the substrate W to be performed. If the electric resistance does not fall within the predetermined allowable range, the resistance checker 80 generates an alarm signal and sends the alarm signal to the controller 69.

If the electric resistance of the inner contact 55 is higher than the predetermined allowable range, a small electric current flows through that inner contact 55. As a result, metal is less deposited around that inner contact 55, resulting in a non-uniform thickness of a metal film. If the electric resistance of the inner contact 55 is lower than the predetermined allowable range, the electric current is concentrated on that inner contact 55, and a large electric current flows through that inner contact 55. As a result, a large amount of metal is deposited around that inner contact 55, resulting in a non-uniform thickness of a metal film. Further, if the electric current flowing through the inner contact 55 is large, the inner contact 55 generates heat, possibly causing a damage to other component of the substrate holder 6. In order to prevent such non-uniform plating and the damage to the substrate holder 6, the resistance-measuring device 70 determines each one of the electric resistances of the inner contacts 55, and the resistance checker 80 determines whether or not each electric resistance is within the predetermined allowable range before the substrate W is plated.

If the electric resistance of a certain inner contact 55 is higher than the predetermined allowable range, such an inner contact 55 may be replaced with a new inner contact. As a result, the electric resistances of all inner contacts 55 can be approximately equal to each other. If the electric resistance of a certain inner contact 55 is lower than the predetermined allowable range, all inner contacts 55 may be replaced with new inner contacts.

Figure 13:
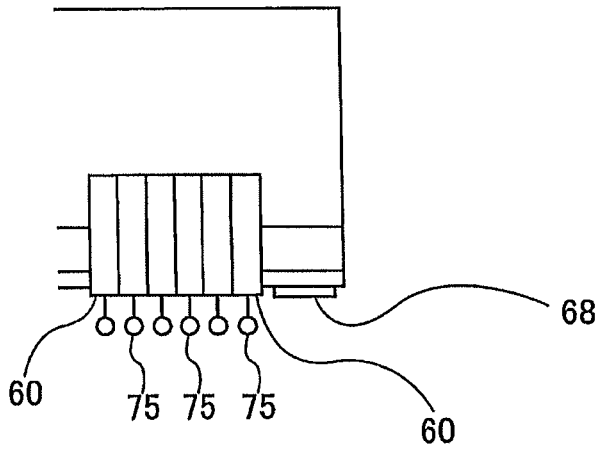
FIG. 13 is a view showing the substrate holder to which variable resistors are attached.
Figure 14:
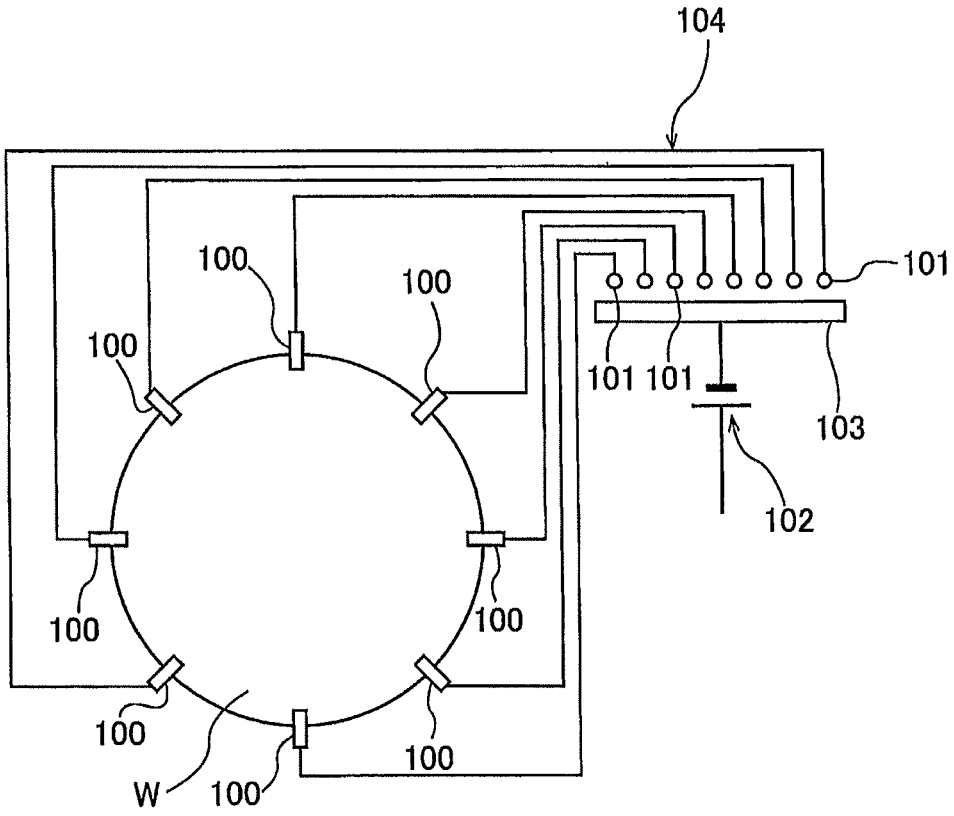
FIG. 14 is a view showing electric paths of a substrate holder.

As shown in FIG. 13, variable resistors (or digital potentiometers) 75 may be attached to the outer contacts 60. In an embodiment, twelve variable resistors 75 are coupled to the twelve outer contacts 60, respectively. The variable resistors 75 can even up electric resistances of electric current paths, including the inner contacts 55, to the highest one of these electric resistances. Therefore, uniform electric current can be passed from the inner contacts (electric contacts) 55 to the substrate W.

The electric resistances of the inner contacts 55 are measured before plating of the substrate W, with the substrate holder 6 holding the substrate W. The reasons of this are as follows. The first reason is to detect a defect of the substrate W. For example, if a uniform conductive layer is not formed on the surface of the substrate W and/or if the surface of the substrate W has an abnormality, the electric resistance of the inner contact 55 is greatly varied. Examples of the abnormality on the surface of the substrate W include existence of an unwanted substance that has been produced when a resist is applied to the surface of the substrate W, and oxidation of the surface of the substrate W.

The second reason is to detect a defect of the substrate holder 6. For example, if the inner contact 55 is deformed or missing, the electric resistance of the inner contact 55 is greatly varied. Other causes that can affect the electric resistance of the inner contact 55 include an adhesion of a resist to the inner contact 55, a damage of the inner contact 55 (e.g., removal of metal plated on the inner contact 55), a deformation or a chip of the outer contact 60, and an adhesion of a foreign matter on the outer contact 60. The resistance checker 80 can detect the defect of the substrate W and/or the defect of the substrate holder 6 based on the determined value of the electric resistance.

The above-discussed embodiment is a method of determining the electric resistance of the inner contact 55 without taking a consideration of resistance components, other than the electric resistances of the two inner contacts 55, of the combined resistance of the electric circuit that includes the two inner contacts 55, the conductive layer of the substrate W, the two outer contacts 60, the two probes 71, and the resistance determiner 72. However, for example, if a surface of the outer contact 60 is oxidized or if a foreign matter adheres to the outer contact 60, the uniformity of film thickness in an actual plated surface is lowered as well. In fact, in the above-mentioned electric circuit, if an electric resistance between the outer contact 60 and the probe 71 is increased due to a certain cause, a higher combined resistance of the electric circuit is measured. That is, the above-discussed method of identifying a problematic inner contact by measuring the combined resistance of the electric circuit while changing the combination of two inner contacts can be, in other words, a method of identifying an electric path that has an abnormal resistance.

Next, processing of the substrate W performed by the plating apparatus will now be described. First, the substrate holder 6 in a vertical positon is taken out of the holder storage bath 13 by the arm 23 of the transporter 20. The arm 23, gripping the substrate holder 6, moves horizontally, and transfers the substrate holder 6 to the substrate-holder tilting mechanism 12. The substrate-holder tilting mechanism 12 changes the substrate holder 6 from the vertical position to the horizontal position, and places the substrate holder 6 onto the table 7. Thereafter, the substrate holder 6 placed on the table 7 is opened by the substrate-holder opening and closing mechanism 11.

The substrate transfer robot 8 takes one substrate W out of the substrate cassette mounted on one of the loading ports 2, and places the substrate W on the aligner 4. The aligner 4 aligns the orientation flat or the notch of the substrate W in the predetermined direction. The substrate transfer robot 8 removes the substrate W from the aligner 4, and inserts the substrate W into the substrate holder 6 on the table 7. In this state, the substrate-holder opening and closing mechanism 11 closes the substrate holder 6, and then locks the substrate holder 6.

Next, the resistance-measuring device 70 moves toward the outer contacts 60 of the substrate holder 6 holding the substrate W until the probes 71 are brought into contact with the outer contacts 60. As described above, the resistance-measuring device 70 measures the combined resistances including the electric resistances of the inner contacts (electric contacts) 55, and determines each one of the electric resistances of the inner contacts 55 from the combined resistances obtained. The determined values of the electric resistances of the inner contacts 55 are transmitted to the resistance checker 80, which then determines whether or not the electric resistance of each inner contact 55 is within the predetermined allowable range. If the electric resistance of each inner contact 55 falls within the predetermined allowable range, the resistance checker 80 sends to the controller 69 the permission signal for permitting the plating operation for the substrate W. Upon receiving the permission signal, the controller 69 allows the units of the plating apparatus to continue processing of the substrate W.

If any one of the electric resistances does not fall within the predetermined allowable range, the resistance checker 80 emits the alarm signal to the controller 69. Upon receiving this alarm signal, the controller 69 operates the plating apparatus as follows. The probes 71 are once moved away from the outer contacts 60, and are brought into contact with the outer contacts 60 again. The resistance-measuring device 70 then measures the combined resistances and determines the electric resistances again. In another embodiment, the probes 71 are once moved away from the outer contacts 60, the substrate W is once removed from the substrate holder 6, and the substrate W is then set in the substrate holder 6 again. Thereafter, the probes 71 are brought into contact with the outer contacts 60, and the resistance-measuring device 70 then measures the combined resistances and determines the electric resistances again.

If the electric resistance of the inner contact 55 does not fall within the predetermined allowable range even after the measurement of the combined resistances and the determination of the electric resistances are repeated a predetermined number of times, the substrate transfer robot 8 removes the substrate W from the substrate holder 6, and returns the substrate W to the substrate cassette. The transporter 20 returns the substrate holder 6 to the holder storage bath 13. Use of the substrate W that has been returned to the substrate cassette and use of the substrate holder 6 that has been returned to the holder storage bath 13 are prohibited.

If the electric resistance of the inner contact 55 does not fall within the predetermined allowable range, only the substrate W may be exchanged. In this case, another substrate is taken out from the substrate cassette and is set in the substrate holder 6. Thereafter, the resistance-measuring device 70 determines the electric resistances of the inner contacts 55, and the resistance checker 80 judges whether or not the electric resistance of each inner contact 55 falls within the predetermined allowable range. If the electric resistance of the inner contact 55 still does not fall within the predetermined allowable range, the substrate holder 6 is judged to have a defect, and the use of the substrate holder 6 is no longer permitted.

If the electric resistance of the inner contact 55 does not fall within the predetermined allowable range, only the substrate holder 6 may be exchanged. The transporter 20 returns this substrate holder 6 to the holder storage bath 13, and places another substrate holder 6 onto the table 7. If the electric resistance of the inner contact 55 still does not fall within the predetermined allowable range in spite of the use of another substrate holder 6, the substrate W is judged to have a defect. The use of this substrate W is prohibited, while the use of the substrate holder 6 is continued. Another substrate W is set in this substrate holder 6.

As discussed above, the embodiment makes it possible to detect an abnormality of the electric resistance between the substrate W and the inner contact 55, or the electric resistance of the outer contact 60, i.e., an abnormality of the contact state, when the substrate W is held by the substrate holder 6 (in other words, before the substrate W is transported to the plating bath). Since the electric feeding state can be checked before the actual plating operation is performed, it is possible to prevent the immersion of the substrate W or the actual plating operation under a bad electric feeding condition. This can yield an improvement of productivity of substrates to be plated, i.e., electronic devices.

After the check of the inner contacts 55 is terminated and it is confirmed that the substrate W and the substrate holder 6 do not have defect, the substrate-holder tilting mechanism 12 changes the substrate holder 6 from the horizontal position to the vertical position. The gripper 24 of the arm 23 grips the substrate holder 6 in the upright position, and the arm 23 moves the substrate holder 6 horizontally to a position above the pre-cleaning bath 14. The lifter 22 of the transporter 20 lowers the arm 23 together with the substrate holder 6 until the substrate holder 6 is set in the predetermined position in the pre-cleaning bath 14. In this state, the pre-cleaning of the substrate W is performed. After the pre-cleaning of the substrate is terminated, the gripper 24 of the arm 23 grips the substrate holder 6. The lifter 22 elevates the arm 23 to thereby raise the substrate holder 6 from the pre-cleaning bath 14.

The arm 23 moves the substrate holder 6 horizontally to a positon above the pretreatment bath 17. The lifter 22 lowers the arm 23 together with the substrate holder 6 until the substrate holder 6 is set in a predetermined position in the pretreatment bath 17. The substrate W is immersed in the pretreatment liquid held in the pretreatment bath 17, so that the pretreatment of the substrate W is performed. After the pretreatment of the substrate W is terminated, the gripper 24 grips the substrate holder 6. The lifter 22 elevates the arm 23 to raise the substrate holder 6 from the pretreatment bath 17.

The arm 23 moves the substrate holder 6 horizontally to a position above the plating bath 15. The lifter 22 of the transporter 20 lowers the arm 23 together with the substrate holder 6 until the substrate holder 6 is set in a predetermined position in the inner bath 34 of the plating bath 15. The substrate W is plated while the substrate W is immersed in the plating solution. After the plating process is terminated, the gripper 24 of the arm 23 grips the substrate holder 6. The lifter 22 elevates the arm 23 to thereby raise the substrate holder 6 from the inner bath 35.

The arm 23 moves the substrate holder 6 horizontally to a position above the rinsing bath 18. The lifter 22 of the transporter 20 lowers the arm 23 together with the substrate holder 6 until the substrate holder 6 is set in a predetermined position in the rinsing bath 18. In this state, rinsing of the plated substrate W is performed. After the rinsing of the substrate W is terminated, the gripper 24 of the arm 23 grips the substrate holder 6, and the lifter 22 elevates the arm 23 to thereby raise the substrate holder 6 from the rinsing bath 18.

The arm 23 moves the substrate holder 6 horizontally to a position above the blow bath 16. The lifter 22 of the transporter 20 lowers the arm 23 together with the substrate holder 6 until the substrate holder 6 is set in a predetermined position in the blow bath 16. The blow bath 16 generates a jet of air blowing onto the surface of the substrate W, held by the substrate holder 6, to remove liquid droplets from the substrate W, thereby drying the substrate W. After the blowing operation is terminated, the gripper 24 of the arm 23 grips the substrate holder 6, and the lifter 22 elevates the arm 23 to thereby raise the substrate holder 6 from the blow bath 16.

The arm 23 moves horizontally, and transfers the substrate holder 6 to the substrate-holder tilting mechanism 12. The substrate-holder tilting mechanism 12 places the substrate holder 6 horizontally on the table 7, and the substrate-holder opening and closing mechanism 11 opens the substrate holder 6 in the same manner as described previously. The substrate transfer robot 8 removes the plated substrate W from the substrate holder 6 and transports the substrate W to the spin-rinse-dryer 5. The spin-rinse-dryer 5 rinses the substrate W with the cleaning liquid and then rotates the substrate W at a high speed to thereby dry the substrate W. The substrate transfer robot 8 removes the dried substrate W from the spin-rinse-dryer 5 and returns the dried substrate W to the substrate cassette on the loading port 2. In this manner, processing of the substrate W is completed.

According to the embodiment described above, defect of the substrate W and/or defect of the substrate holder 6 can be detected based on the electric resistances of the inner contacts 55 before plating of the substrate W is started. Therefore, the substrate W can be plated with use of only normal substrate W and normal substrate holder 6. As a result, uniform electric current can be passed to the substrate W, and a metal film having a uniform thickness can be formed on the surface of the substrate W.

If the defect of the substrate holder 6 is detected during operation of the plating apparatus, the operation of the plating apparatus must be stopped. As a result, a throughput of the plating apparatus is decreased. In order to prevent this, it is preferable to check the substrate holder 6 using a dummy substrate before processing of the substrate W is started. More specifically, the dummy substrate having a conductive layer (e.g., a conductive blanket film), such as a seed layer, is set in the substrate holder 6, and the electric resistances of all of the inner contacts 55 are determined as discussed above. The dummy substrate is successively set in all substrate holders 6 to be used, and the electric resistances of all of the inner contacts 55 are determined. If a substrate holder 6 having a defect is detected, use of that substrate holder 6 is prohibited.

In the above-described embodiment, it is judged that the substrate has defect or the substrate holder 6 has defect if the electric resistance of the inner contact 55 does not fall within the predetermined allowable range. However, even if the electric resistance of the inner contact 55 does not fall within the predetermined allowable range when measured in a certain measurement pattern, the plating operation may be continued as long as actual plating is not affected. In a conventional measurement method, an individual electric resistance of each one of the inner contacts 55 cannot be determined. Therefore, a relationship between data on uniformity of plating film thickness and the electric resistance of the inner contact 55 cannot be investigated.

According to the above-discussed embodiment, data on the uniformity of the plating film thickness can be compared with data on distribution of the electric resistances of the inner contacts 55. Therefore, it is possible to determine a measurement pattern in which the plating operation should be stopped if the electric resistance of the inner contact 55 exceeds the allowable range. In other words, it is possible to determine a particular measurement pattern in which the plating operation can be permitted to be performed even if the electric resistance of the inner contact 55 exceeds the allowable range.

A specific example will be described with reference to FIG. 9. The plating can be permitted to be performed in a case where accumulated previous data on the uniformity of the film thickness demonstrate that there is no influence on the uniformity of the film thickness even if one of the inner contacts 55 (for example, the first inner contact 55) has an electric resistance exceeding the allowable range.

Further, the plating operation may be permitted even if one of the inner contacts 55 (for example, the first inner contact 55) and the seventh inner contact 55 at a diagonal location, or the first inner contact 55 and the inner contact 55 next to the seventh inner contact 55 (i.e., the sixth inner contact 55 or the eighth inner contact 55) have the electric resistances exceeding the allowable range. In this manner, the previously obtained data on the uniformity of the film thickness and the data on the distribution of the electric resistances of the inner contacts 55 are analyzed in order to accumulate NG (no good) measurement patterns that can permit the plating operation (i.e., measurement patterns in which the electric resistances exceed the allowable range). As a result, the operation of the plating apparatus is not stopped any more than necessary, and it is possible to prevent a decrease in throughput of the plating apparatus.

Although the embodiments of the present invention have been described above, it should be noted that the present invention is not intended to be limited to the above embodiments, and may be reduced to practice in various different embodiments within the scope of the technical concept of the invention.

What is claimed is:

1. A plating apparatus comprising:

a substrate holder for holding a substrate and having plural electric contacts that can be brought into contact with the substrate while holding the substrate, the substrate holder having a sealing member for pressing against a periphery of the substrate;

a plating bath for storing a plating solution therein, the substrate holder being able to be immersed in the plating solution held by the plating bath;

an anode disposed in the plating bath; and a resistance-measuring device configured to measure combined resistances of the substrate and the plural electric contacts, the resistance-measuring device is configured to measure a combined resistance of the substrate and two electric contacts selected from the plural electric contacts while the substrate holder is holding the substrate, repeat measuring of a combined resistance of the substrate and two electric contacts while changing a combination of two electric contacts until a same number of plural combined resistances as the plural electric contacts are measured, create linear equations by coupling each of the plural combined resistances to two variables with use of an equal sign, the two variables representing electric resistances of the corresponding two electric contacts, and solve the linear equations to determine each one of electric resistances of the plural electric contacts.

2. The plating apparatus according to claim 1, further comprising:

a resistance checker configured to determine whether the determined electric resistance falls within a predetermined range.

3. The plating apparatus according to claim 2, wherein the resistance checker is configured to emit an alarm signal after detecting that the determined electric resistance does not fall within the predetermined range.

4. The plating apparatus according to claim 1, wherein the resistance-measuring device is configured to determine each one of electric resistances of the plural electric contacts before the substrate is transported to the plating bath.

5. A method of determining electric resistances of plural electric contacts of a substrate holder for use in plating of a substrate, comprising:

preparing the substrate holder having a sealing member;

holding the substrate by the substrate holder, while bringing the plural electric contacts into contact with the substrate and pressing the sealing member against a periphery of the substrate;

measuring a combined resistance of the substrate and two electric contacts selected from the plural electric contacts;

repeating measuring of a combined resistance of the substrate and two electric contacts while changing a combination of two electric contacts until a same number of plural combined resistances as the plural electric contacts are measured;

creating linear equations by coupling each of the plural combined resistances to two variables with use of an equal sign, the two variables representing electric resistances of the corresponding two electric contacts; and solving the linear equations to determine each one of electric resistances of the plural electric contacts.

6. The plating apparatus according to claim 1, wherein the resistance-measuring device comprises:

a measurement power source;

probes;

first switches electrically connected to the probes, respectively, the first switches being electrically connected to a positive electrode of the measurement power source;

second switches electrically connected to the probes, respectively, the second switches being electrically connected to a negative electrode of the measurement power source; and a resistance determiner electrically connected to the probes.

* * * * *